US006615880B2

(12) United States Patent
Hewlitt et al.

(10) Patent No.: US 6,615,880 B2
(45) Date of Patent: Sep. 9, 2003

(54) PROCESS AND MACHINE FOR PRODUCT MIXING

(75) Inventors: Timothy Hewlitt, London (GB); Steven Kelsey, London (GB); William Maskell, London (GB); Jerard O'Brien, London (GB)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/842,517

(22) Filed: Apr. 25, 2001

(65) Prior Publication Data

US 2003/0075233 A1 Apr. 24, 2003

(30) Foreign Application Priority Data

Apr. 25, 2000 (EP) ..... 00303426

(51) Int. Cl.[7] ..... B65B 3/04

(52) U.S. Cl. ..... 141/9; 141/104; 141/105; 141/106; 141/107; 141/234; 141/236

(58) Field of Search ..... 141/9, 2, 18, 104–107, 141/234, 236; 222/129.3, 144.5, 148; 366/138, 192, 196; 137/625.11, 624.2

(56) References Cited

U.S. PATENT DOCUMENTS

| | | | | | |
|---|---|---|---|---|---|
| 3,167,210 | A | | 1/1965 | Carney, Jr. | 220/63 |
| 3,307,744 | A | * | 3/1967 | Burford | 222/1 |
| 3,595,438 | A | * | 7/1971 | Daley et al. | 222/67 |
| 3,727,889 | A | * | 4/1973 | Nagel | 366/162.1 |
| 3,966,091 | A | | 6/1976 | Bencic | 222/129.1 |
| 4,006,841 | A | | 2/1977 | Alticosalian | 222/42 |
| 4,077,182 | A | | 3/1978 | Papaluca | 53/109 |
| 4,324,494 | A | * | 4/1982 | Pryor et al. | 222/129.3 |
| 4,330,066 | A | | 5/1982 | Berliner | 215/1 C |
| 4,832,096 | A | | 5/1989 | Kohlbach | 141/114 |
| 4,929,818 | A | | 5/1990 | Bradbury et al. | 235/381 |
| 4,934,567 | A | | 6/1990 | Vahjen et al. | 222/136 |
| 4,981,024 | A | * | 1/1991 | Beldham | 68/12.18 |
| 5,014,211 | A | * | 5/1991 | Turner et al. | 137/266 |
| 5,020,917 | A | | 6/1991 | Homan | |
| 5,067,636 | A | | 11/1991 | Pfeiffer et al. | 222/105 |
| 5,285,815 | A | | 2/1994 | Henry et al. | 137/595 |
| 5,429,263 | A | | 7/1995 | Haubenwallner | 220/404 |
| 5,516,007 | A | | 5/1996 | Larson | 222/105 |
| 5,584,327 | A | * | 12/1996 | Thomas et al. | 137/625.11 |
| 5,592,940 | A | * | 1/1997 | Kampfe et al. | 141/83 |
| 5,685,435 | A | | 11/1997 | Picioccio et al. | 209/677 |
| 5,758,571 | A | | 6/1998 | Kateman et al. | 99/455 |
| 5,799,281 | A | * | 8/1998 | Login et al. | 705/1 |
| 5,870,906 | A | * | 2/1999 | Denisar | 68/17 R |
| 5,873,268 | A | * | 2/1999 | Spriggs et al. | 68/17 R |
| 5,955,132 | A | | 9/1999 | Spica et al. | 426/399 |
| 5,996,316 | A | | 12/1999 | Kirschner | 53/443 |
| 5,996,824 | A | | 12/1999 | Grant et al. | 215/2 |
| 5,997,236 | A | | 12/1999 | Picioccio et al. | 414/403 |

FOREIGN PATENT DOCUMENTS

| | | | |
|---|---|---|---|
| DE | 27 14 919 A1 | 10/1977 | B65D/43/02 |
| DE | 37 27 789 A1 | 3/1988 | B65D/47/20 |
| DE | 39 22 779 A1 | 1/1991 | B65B/3/04 |

(List continued on next page.)

*Primary Examiner*—Timothy L. Maust

(57) ABSTRACT

A process is provided for the mixing of one or more concentrates in a machine, wherein one or more concentrates and/or one or more diluents are mixed together in a mixing chamber; and the product is dispensed from said machine into a storage container. A machine is also provided for the mixing of one or more concentrates, wherein said machine comprises one or more diluent sources and one or more concentrate sources, said diluent and concentrate sources being in fluid communication with one or more mixing chambers. Further, a process is provided for the simultaneous multiple mixing and dispensing of a plurality of products employing a machine comprising one or more diluent sources and one or more concentrate sources, said diluent and concentrate sources being in fluid communication with a plurality of mixing chambers.

7 Claims, 1 Drawing Sheet

FOREIGN PATENT DOCUMENTS

| | | | | |
|---|---|---|---|---|
| DE | 44 39 914 | A1 | 5/1996 | ..... B65D/23/08 |
| DE | 196 07 255 | A1 | 8/1997 | ..... B65B/3/00 |
| DE | 198 13 842 | A1 | 9/1999 | ..... B65G/47/49 |
| DE | 299 13 528 | U1 | 1/2000 | ..... G07F/17/18 |
| DE | 199 36 645 | A1 | 4/2000 | ..... B67D/5/34 |
| EP | 0 358 053 | A2 | 3/1990 | ..... B65D/77/06 |
| EP | 0 479 113 | A1 | 4/1992 | ..... B67D/1/00 |
| EP | 0 499 918 | A2 | 8/1992 | ..... E21D/11/00 |
| EP | 0501015 | A1 | 9/1992 | ..... B65D/77/06 |
| EP | 0 528 394 | A1 | 2/1993 | ..... B65D/77/06 |
| EP | 0 649 121 | A2 | 4/1995 | ..... G07F/17/16 |
| FR | 1 180 592 | | 6/1959 | ..... 20/4 |
| GB | 2188906 | A | 10/1987 | ..... B67D/5/56 |
| GB | 2244977 | A | 12/1991 | ..... B67D/5/56 |
| WO | WO 94/24010 | | 10/1994 | ..... B65D/25/00 |
| WO | WO 96/01227 | | 1/1996 | ..... B67D/5/56 |
| WO | WO 97/02898 | | 1/1997 | ..... B05B/7/28 |
| WO | WO 97/18538 | | 5/1997 | ..... G07F/13/08 |
| WO | WO 00/03944 | | 1/2000 | ..... B67D/1/08 |

* cited by examiner

PROCESS AND MACHINE FOR PRODUCT MIXING

This application claims priority to the foreign application filed on Apr. 25, 2000, in Europe and having a serial number of 00303426.1.

FIELD OF THE INVENTION

The present invention relates to a process and machine for product mixing.

BACKGROUND OF THE INVENTION

Methods of product mixing or reconstitution are known in the art, wherein liquid concentrates are mixed with a diluent by means of an aspirator containing a venturi. In this method, the venturi draws liquid concentrate into contact with the diluent stream, thereby mixing concentrate and diluent together. In such a method, any number of concentrates may be envisaged.

For example, U.S. Pat. No. 5,584,327 discloses a solution storage and dispensing apparatus for forming solutions in a plurality of storage containers using a single dispenser to selectively direct a first liquid, such as water, to each of the storage containers for forming solutions therein.

An aspirator located in each of the storage containers draws a second liquid, such as a concentrate, into the storage container in response to the flow of the first liquid through the aspirator to provide a controlled concentration of solution in the container.

The method employed in U.S. Pat. No. 5,584,327 is limited to the reconstitution of liquid products. Such a method is further limited in that concentrates must have a inherently high solubility in the diluent used.

Filling machines may dispense a wide variety of products from the same machine. Such machines may include production line filling machines and vending systems which are designed to fill containers at sites located in, for example, retail outlets, offices and other workplaces.

By "vending system" in the present invention, is meant a filling machine that dispenses product in response to one or more selections that are input into the machine by the user. Such a system may be operated by coin, token, card or other suitable means.

In a situation where multiple vends of a variety of concentrate combinations are required from the same machine, the potential for contamination is increased.

Typically, the design of filling machines, such as vending machines, avoids the contamination issue by isolating the concentrates and filling them directly into the container prior to adding the diluent. This method is effective in avoiding contamination but does not allow the effective mixing and reconstitution of the concentrate.

The mixing of concentrates with diluents and/or the addition of customised combinations of concentrates adds complexity and the potential for contamination in filling machines.

The alternative method of dispensing concentrates into the container and adding the diluent does not provide a consistently well mixed product and limits the range of concentrate formulations possible by such a method to those formulations that have an inherently high solubility.

The limitations imposed by the current state of the art are such that it is difficult to implement a filling machine, in particular a vending machine, that can give the user the guarantee of a well-reconstituted product.

In addition, the mixing and reconstitution of the product components is limited by the ability of the method to handle disparate product types, and the formulation is usually limited to one physical type at the exclusion of others, for example, liquid, powder or paste.

Furthermore, maintaining the quality of product reconstitution with any permutation of the amount or physical characteristics of constituents is difficult to achieve.

SUMMARY OF THE INVENTION

According to the present invention there is provided a process for the mixing of one or more concentrates in a machine, wherein (i) one or more concentrates and/or one or more diluents are mixed together in a mixing chamber; and (ii) the product is dispensed from said machine into a storage container.

In a further aspect, the present invention provides a machine for the mixing of one or more concentrates, wherein said machine comprises one or more diluent sources and one or more concentrate sources, said diluent and concentrate sources being in fluid communication with one or more mixing chambers.

In a preferred embodiment of the present invention, the machine is a filling machine, more in particular, a vending system.

The design of the machine of the present invention serves to allow concentrates with different physical characteristics, such as solids and liquids, to be mixed together. For example, solids such as pellets and powders may be added to the mixing chamber by a hopper feed.

The design of the machine serves to eliminate contamination problems arising from previous product mixtures, by providing discrete concentrate and diluent conduits, and by ensuring mixing of concentrates and/or diluents occurs only in the mixing chamber.

The diluent and concentrate sources are in fluid communication with the mixing chamber by conduits, and are controlled by a series of control valves and augers of the kind commonly used in the art.

In a preferred embodiment of the present invention, the machine comprises one or more diluent sources and one or more concentrate sources, the diluent and concentrate sources are in fluid communication with a plurality of mixing chambers, said mixing chambers each being linked in turn to a separate dispense point. Said dispense points may be controlled by any means known in the art, for example a control valve or auger.

It is therefore possible to offer a process for the simultaneous multiple mixing and dispensing of a plurality of products employing a machine comprising one or more diluent sources and one or more concentrate sources, said diluent and concentrate sources being in fluid communication with a plurality of mixing chambers.

By "concentrate" in the present invention is meant a bulk concentrate for reconstitution which contains all of the formulation components. "Concentrate" is also intended to embrace a generic concentrate which contains only the basic formulation components in concentrated form. Said concentrate may be further customised by the addition of one or more additives to the mixing chambers so as to provide further features and properties to the subsequently reconstituted product. In this case, it will be appreciated that said additives can also be considered as being "concentrates" in their own right.

Thus, in this embodiment, additive sources may be in fluid communication with the mixing chamber. Said additive sources may be of disparate types, for example, liquids and solids.

In the present invention, one or more concentrates and/or diluents may be dosed into the mixing chamber according to the users instructions and final requirements, and may be mixed by a variety of mechanisms.

It will be appreciated that the order of mixing is not limited in the present invention. For example, one or more concentrates may be mixed together prior to the addition of one or more diluents, or vice versa. In a further example, it is possible to add all concentrates and diluents simultaneously and then subsequently mix said concentrates and diluents together. A number of permutations in addition and mixing steps are therefore possible.

Said one or more concentrate and/or diluents may be mixed in the mixing chamber until an even and homogeneous mix is achieved, or alternatively, a mix is achieved that will produce a consistency or effect that is appropriate to the intended specification.

In the case where a reconstituted product is desired, one or more diluents may be added to the mixing chamber.

Said one or more concentrate sources and one or more diluents may then be mixed together to reconstitute the product to achieve its desired concentration, physical properties or chemical properties.

Said optionally reconstituted product may then be dispensed into a storage container.

The nature of the storage container that may be employed in the present invention is not limited. It will be appreciated that said storage container may be an integral part of the machine. Alternatively, it is possible to dispense the reconstituted product into a standard external storage container of the kind known in the art.

Standard storage containers are available in a wide variety of shapes and forms. They may be assembled from a wide variety of components, and may be manufactured from a wide variety of materials.

Said containers may be manufactured from a plastics material. As such, said container may be manufactured by any conventional process for the forming of plastics material, such as by an extrusion or an injection blow-moulding process. Suitable plastics materials include any appropriate to the requirements of the product including, by way of example, Polyethylene Terephthalate (PET), Polypropylene (PP), Polyethylene (PE), High Density Polyethylene (HDPE), Polyvinyl Chloride (PVC) and barrier laminates such as PET/NYLON/PET and PP/BAREX®/PP etc. (BAREX® is a trade mark of BP Amoco plc).

The storage container may be an open vessel. However, in a preferred embodiment of the present invention, the storage container will contain a bottom portion, side walls and an upper portion.

Said storage container may comprise any number, combination and orientation of fill and/or dispense apertures that meet the needs of the product, its intended use or its method of use.

It will be appreciated by one skilled in the art, that the fill aperture of said storage container will preferably open and re-close by some function of the filling process, by the action of the filling machine, or a mechanism thereof. It will be further appreciated that in the case where the fill aperture also acts as the dispense aperture, that said fill aperture may be designed to be opened manually by the user, in addition to automatic opening when in connection with the filling head.

The storage container may include any dispensing, dosing or application feature or device providing the means to dispense the product in a wide variety of ways.

The container may include provision for manual or powered dispensing.

The container may include any further device or mechanism for filling known in the art.

In a preferred embodiment of the present invention, the process will include an optional step (iii) after product dispense comprising a flush cycle with one or more diluents in order to clean the mixing chamber and/or dispense point prior to re-use.

Concentrate and/or diluent sources will be housed in bulk reservoirs inside the machine, or fed into the machine from an external location through conduits.

The mixing chamber and said bulk reservoirs may be standard containers known in the art, or alternatively, for space efficiency, they may be bespoke moulded containers. Bespoke moulded containers could, for example, be of such a shape that corresponds to the internal shape of a filling machine, so maximising storage space.

The mixing chamber not only provides a more consistent mix than methods and apparatus known in the art, but said chamber also facilitates the handling and reconstitution of disparate product types, such as liquids and solids.

Concentrates and/or diluents may be added into the mixing chamber vertically, or may be added tangentially along the wall of the mixing chamber to aid mixing.

The mixing mechanism in the present invention is not limited and will vary according to the nature of the product being mixed, and may involve, for example, using a rotor paddle, centrifuge or vibration methods.

It will be appreciated that the speed of mixing is a key factor when dispensing products. This variable will therefore be selected to achieve a balance between the quality of mixing and the amount of time inherent in the mixing process before dispense may occur.

The machine and process of the present invention may be conveniently used to reconstitute a wide variety of materials which may typically be concentrated and then reconstituted. For example, the machine and process of the present invention may be applied to foodstuffs, beverages, household products such as cleaning products and detergents, and automotive products such as lubricants.

BRIEF DESCRIPTION OF THE DRAWINGS

The present invention will now be described by way of example with reference to the accompanying drawings. It is to be noted, however, that the accompanying drawings illustrate only some embodiments of the invention and are therefore not to be considered limiting of its scope, because the invention may admit to other equally effective embodiments.

DETAILED DESCRIPTION OF THE INVENTION

Figure 1:
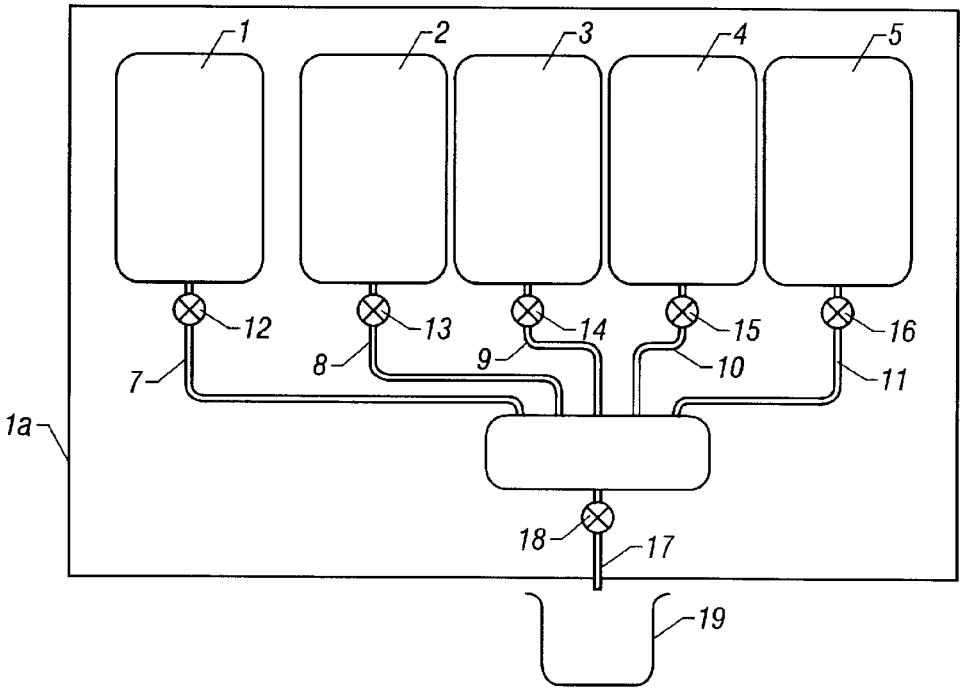
FIG. 1 is a functional block diagram of a system comprising a diluent source and a plurality of concentrate sources, each being in fluid communication with a common mixing chamber.

Referring to FIG. 1, a machine 1*a* comprises a diluent source 1, for example water, and a plurality of concentrate sources 2 to 5. Said diluent and concentrate sources are in fluid communication with a mixing chamber 6 through a series of conduits 7 to 11, respectively controlled by control valves 12 to 16. Said control valves 12 to 16 may be automatically or manually operated. Said mixing chamber 6 in fluid communication with a dispense point 17, which is controlled by a control valve 18, said dispense point 17 serving to dispense product to a storage container 19, which may be an integral component of the machine, or in an alternative embodiment, may be external to the machine. It is emphasised that said storage container 19 is shown in FIG. 1 in a purely representative manner, and can be of any suitable form.

For example, in the case that the desired product is a reconstituted mixture of concentrates 2 and 4, the machine operator may select the desired combination of sources 1, 2 and 4 either manually by manipulating the appropriate control valves 12, 13 and 15, respectively. Alternatively, the operator may input selections to a machine interface, said interface registering the selection and controlling the appropriate valves automatically. The dosing of said combination will depend upon the time the control valves remain open. Sources 1, 2 and 4 are then mixed in the mixing chamber for the desired length of time before the control valve 18 is opened manually or automatically, allowing dispense to the storage container 19.

Figure 2:
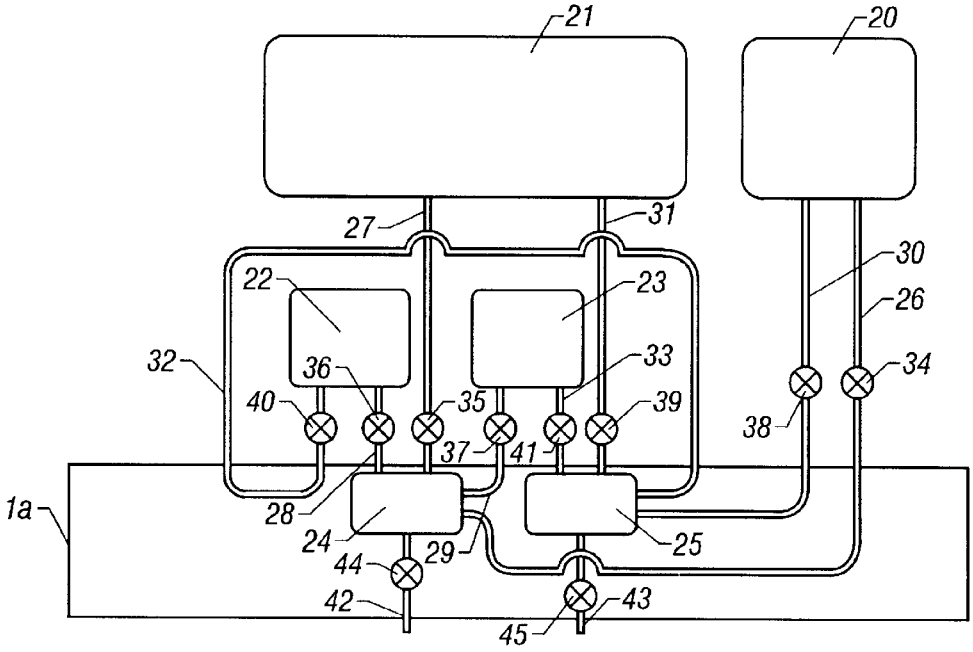
FIG. 2 is a functional block diagram of a system comprising a diluent source and a plurality of concentrate sources, each being in fluid communication with a plurality of mixing chambers.

Referring to FIG. 2, a system comprises a diluent source 20, for example water, and a plurality of concentrate sources 21 to 23. Said diluent and concentrate sources 20 to 23 are in bulk reservoirs in fluid communication with mixing chambers 24 and 25 through a series of conduits 26 to 29 and 30 to 33, respectively. The diluent and concentrate sources can be fed into a machine 1*a* from an external location through the conduits. Said conduits are controlled by control valves 34 to 41, respectively. Said control valves may be automatically or manually operated. Said mixing chambers 24 and 25 are in fluid communication with dispense points 42 and 43 which are controlled by control valves 44 and 45, respectively. Said dispense points 42 and 43 dispense product to storage containers (not shown), which may be integral components of the machine, or in an alternative embodiment, may be external to the machine.

For example, in the case that there are two desired products which are a reconstituted mixture of concentrates 21 and 22 and a concentrate mixture of concentrates 21 and 23 respectively, a machine operator or two independent machine operators may simultaneously select the desired combination of sources, that is to say, sources 20, 21 and 22 in the case of the first desired product and sources 21 and 23 in the case of the second desired product. Said selections may be made either manually by manipulating the appropriate control valves or preferably in an automated fashion by inputting selections to a machine interface. Said machine interface then registers the selection and controls the valves automatically, thereby dosing and diverting independent product selections to independent mixing chambers. Thus, sources 20, 21 and 22 will be mixed in mixing chamber 24, whilst sources 21 and 23 will be mixed in mixing chamber 25. Each of the desired products is mixed in the mixing chambers 24 and 25 for the required length of time before the control valves 44 and 45 are opened either manually or automatically. Said desired products are then dispensed through dispense points 42 and 43 to storage containers.

It is emphasised that by appropriate design of the above-described machine systems, they can accommodate as many concentrate and diluent sources as required, and as many dispense points as required. These can be achieved by selection of the appropriate numbers of mixing chambers.

While the foregoing is directed to various embodiments of the present invention, other and further embodiments may be devised without departing from the basic scope thereof. For example, the various methods and embodiments of the invention can be included in combination with each other to produce variations of the disclosed methods and embodiments. Also, the directions such as "top," "bottom," "left," "right," "upper," "lower," and other directions and orientations are described herein for clarity in reference to the figures and are not to be limiting of the actual device or system or use of the device or system. The device or system may be used in a number of directions and orientations. Further, the order of steps can occur in a variety of sequences unless otherwise specifically limited. The various steps described herein can be combined with other steps, interlineated with the stated steps, and/or split into multiple steps.

What is claimed is:

1. A system for the mixing of one or more concentrates to form a product, comprising a vending machine, said vending machine comprising one or more diluent sources and one or more concentrate sources, said diluent and concentrate sources being in fluid communication with one or more mixing chambers, the mixing chamber being adapted to mix the diluent and concentrate sources prior to dispense, the product being selected from cleaning products and detergents, the vending machine further comprising one or more dispense points adapted to dispense the product into a storage container when the storage container is positioned for dispensing from the vending machine.

2. The system according to claim 1, wherein the diluent and concentrate sources are in fluid communication with a plurality of mixing chambers, said mixing chambers each being linked in turn to a separate dispense point.

3. The system of claim 1, wherein at least one of sources comprises a solid.

4. The system of claim 3, wherein the solid comprises a plurality of pellets, one or more powders, or a combination thereof.

5. The system according to claim 1, wherein said machine is a filling machine.

6. The system according to claim 2, wherein said machine is a filling machine.

7. A process for mixing and dispensing at least one product being selected from cleaning products and detergents, comprising:

a. providing a vending machine comprising at least one concentrate source and at least one diluent source, and at least one mixing chamber;

b. initiating a dispense of the product;

c. mixing an amount of concentrate from the concentrate source with an amount of diluent from the diluent source in the mixing chamber to form the product prior to dispensing the product; and d. dispensing the product into a storage container when the storage container is positioned for dispensing from the vending machine.

* * * * *